US005900073A

United States Patent [19]

Sienkowski et al.

[11] Patent Number: 5,900,073

[45] Date of Patent: May 4, 1999

[54] SLUDGE REDUCING ZINC PHOSPHATING PROCESS AND COMPOSITION

[75] Inventors: Michael L. Sienkowski, Warren; Michael Petschel, Troy, both of Mich.

[73] Assignee: Henkel Corporation, Gulph Mills, Pa.

[21] Appl. No.: 08/760,023

[22] Filed: Dec. 4, 1996

[51] Int. Cl.[6] ..... C23C 22/48

[52] U.S. Cl. ..... 148/247; 148/253; 148/261; 148/262; 148/273; 148/275; 148/279; 148/283

[58] Field of Search ..... 148/247, 253, 148/261, 262, 273, 275, 279, 283, 500, 472.3; 106/14.12; 210/739, 742

[56] References Cited

U.S. PATENT DOCUMENTS

| | | | |
|---|---|---|---|
| 4,490,185 | 12/1984 | Gottwald | 148/262 |
| 4,793,867 | 12/1988 | Charles et al. | 148/262 |
| 4,838,957 | 6/1989 | Miyamoto | 148/262 |
| 5,200,000 | 4/1993 | Yamamoto | 148/262 |
| 5,207,840 | 5/1993 | Riesop | 148/262 |
| 5,232,523 | 8/1993 | Endo | 148/262 |
| 5,308,413 | 5/1994 | Sobata | 148/262 |
| 5,536,336 | 7/1996 | Nakatsukasa | 148/262 |

*Primary Examiner*—David A. Simmons
*Assistant Examiner*—Robert R. Koehler
*Attorney, Agent, or Firm*—Wayne C. Jaeschke; Norvell E. Wisdom, Jr.; Lance G. Johnson

[57] ABSTRACT

Equations have been developed to predict the amount of sludge formed during, and the values of several other characteristics of, zinc phosphating processes. Using these equations, novel compositions that achieve low sludge without sacrificing other characteristics of good zinc phosphate coatings have been discovered.

18 Claims, No Drawings

SLUDGE REDUCING ZINC PHOSPHATING PROCESS AND COMPOSITION

BACKGROUND OF THE INVENTION

1. Field of the Invention

The invention relates to a process for forming a zinc containing phosphate conversion coating layer on an active metal surface, more particularly a surface selected from the group consisting of (i) steel and other non-passivating ferrous alloys that contain at least 50% by weight of iron, (ii) galvanized steel, and (iii) other surfaces of zinc or its alloys that contain at least 50% by weight of zinc.

2. Statement of Related Art

It is well known that zinc phosphate conversion coating processes produce a solid byproduct called "sludge" in addition to the desired solid conversion coating on the metal being phosphated. In order to continue using a liquid conversion coating composition, sludge eventually has to be removed from the bath and disposed of in an approved landfill site. Sludge reduction is of interest because the number of available landfill sites for disposal of this byproduct is dwindling and known recycling alternatives through chemical treatment are not economical at this time.

A phosphate species that is insoluble, is almost always generated in the phosphating of any iron containing material, even if the principal surface that is conversion coated is zinc, and is most likely be found in sludge, is $FePO_4$. However, when sludge from zinc phosphating of steel or galvanized steel is analyzed, it is most often found to contain zinc and iron in a 1:3 ratio, indicating that there are other components that also precipitate during the operation. Sludge is generated through three main pathways: Zinc dihydrogen phosphate, the zinc phosphate species with which most zinc phosphating liquid compositions are most nearly at equilibrium, is less soluble at higher temperatures than at lower temperatures, so that some sludge may form during the heating of the composition. The solubility of zinc dihydrogen phosphate is also pH dependent. As a result, some sludge will also form during the neutralization of the bath necessary to maintain the optimum free acid value during continued use of a composition. The third, and unavoidable, source of sludge when treating iron, stems from the reactions that produce the phosphate conversion coating itself.

A typical zinc phosphating bath includes phosphate ions, divalent metal ions, hydrogen ions, and an oxidizing compound such as nitrite or chlorate as the process accelerator. The mechanism of the reaction involves acid attack on the substrate metal, iron in this instance, at micro anodes and deposition of phosphate crystals at micro cathodes. It also involves the liberation of hydrogen and the formation of phosphate sludge. Changes in accelerator can affect the amount of sludge formed, but in general no completely satisfactory theoretical analysis for predicting the amount of sludge under a wide variety of operating conditions has been known.

DESCRIPTION OF THE INVENTION

Objectives of the Invention

One major objective of the invention is to provide a method for predicting the amount of sludge generated under varying operating conditions. Another concurrent or alternative major objective is to provide process conditions that will lead to less sludge generation than previously used process condition, while not substantially worsening the protective and/or aesthetic quality of the phosphate coating achieved. Other objectives will appear from the description below.

General Principles of Description

Except in the claims and the operating examples, or where otherwise expressly indicated to the contrary, all numerical quantities in this description indicating amounts of material or conditions of reaction and/or use are to be understood as modified by the word "about" in describing the broadest scope of the invention. Practice within the numerical limits stated is generally preferred, however. Also, throughout the description and claims, unless expressly stated to the contrary: percent, "parts of", and ratio values are by weight; the term "polymer" includes "oligomer", "copolymer", "terpolymer", and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, and does not necessarily preclude chemical interactions among the constituents of a mixture once mixed; specification of materials in ionic form implies the presence of sufficient counterions to produce electrical neutrality for the composition as a whole, and any counterions thus implicitly specified preferably are selected from among other constituents explicitly specified in ionic form, to the extent possible; otherwise such counterions may be freely selected, except for avoiding counterions that act adversely to the objects of the invention; and the term "mole" and its variations may be applied to ionic, chemically unstable neutral, or any other chemical species, whether actual or hypothetical, that is specified by the type(s) of atoms present and the number of each type of atom included in the unit defined, as well as to substances with well defined neutral molecules.

Detailed Description of the Invention, Including Preferred Embodiments

It has been found that the amount of sludge produced and values for various protective quality related characteristics of the conversion coatings formed by zinc-manga-nese-nickel phosphating within a range of zinc, nitrite accelerator, and free acid concentrations and phosphating temperatures can be closely predicted with empirical equations, and that these equations can be used to define improved narrow operating ranges that reduce sludge without substnatially lowering protective and aesthetic values achieved by the conversion coating.

The amount of sludge produced is defined for the purposes of this description as the stoichiometric equivalent as ferric phosphate dihydrate of the iron that is dissolved from a cold rolled steel substrate during formation of a phosphate conversion coating but is not incorporated into the coating. This value is closely correlated with the mass or volume of dry sludge, the part that requires land fill of the actual sludge that is produced, but direct measurement of the amount of dry sludge is complicated by the inherently variably hydrated nature of sludge as it is produced. On the other hand, the mass of a substrate before coating, the mass of coating formed, the mass of the substrate after coating and stripping of the coating, and the iron content of the stripped coating can all be precisely determined by methods well known to those skilled in the art (the particular methods used during the work that led to this invention being described further below), and from these values the amount of iron dissolved from the substrate but not incorporated into the coating can be readily calculated according to the equation:

$$\text{Dry Sludge Mass}=\{\text{Metal Loss}-[\text{Coating Weight}\times P\text{-ratio}\times(56/449)]\}\times 187/56\ \text{g/m}^2.$$

The fraction 56/449 represents the ratio of the atomic weight of iron to the formula weight of phosphophyllite, which has the chemical formula $Zn_2Fe(PO_4)_2.4H_2O$). The fraction 187/56 represents the inverse ratio of the atomic weight of iron to the formula weight of $FePO_4.2H_2O$ (sludge). This treatment does not ignore the facts that, in practice, the best sludge composition for easy removal has a Fe/Zn ratio of 3:1 and that manganese modified phosphating compositions will normally contain other metal ions than iron in the sludge. It is believed, however, and therefore assumed for purposes of this description, that the major contribution to a reduction in sludge will come from a reduction in the amount of iron dissolved in the course of phosphating but not incorporated into the coating as phosphophylite.

Utilizing this definition of the amount of sludge formed per unit area of metal substrate surfaces coated, the amounts of sludge produced during a two minute immersion time, when phosphate conversion coating a cold-rolled steel surface with a coating forming composition having an acidic pH value and containing zinc cations, phosphate anions, and nitrite accelerator and, optionally, also one or more of manganese cations, nickel cations, simple and complex fluoride anions, and nitrate anions, varies as a function of the zinc ("z"), nitrite accelerator ("n"), and Free Acid ("f") concentrations of the composition and the temperature ("T") at which the coating forming composition is maintained during the immersion contact, with all concentrations of other necessary and optional components recited above being held constant, according to the equation shown in Table 1 below. The effects of these same variables on some of the characteristics of the phosphate conversion coatings formed on various substrates are also predictable according to other equations also shown in Table 1. (The amount of iron removed from a substrate can not be so easily determined when, as with galvanized steel, iron is not the overwhelmingly predominant constituent of the surface of the substrate being coated. Therefore, no attempt was made to determine the amount of sludge generated by phosphating zinciferous

TABLE 1

| Predicted Value of: | Empirical Equation |
|---|---|
| Sludge, g/m$^2$ = | 2.69−(0.1919){(T−46)/6}−(0.3481){(z−1.0)/0.2}+(0.7831){(f−0.8)/0.4}−(0.3169){(n−0.17)/0.185}−(0.2381){(T−46)/6}{(f−0.8)/0.4}−(0.3406){(f−0.8)/0.4}{(n−0.17)/0.185} |
| CRS Ct.Wt., = g/m$^2$ | 2.24+(0.3294){(z−1.0)/0.2}−(0.5794){(f−0.8)/0.4}−(0.4244){(n−0.17)/0.185}+(0.3206){(f−0.8)/0.4}{(n−0.17)/0.185} |
| CRS Metal = Loss, g/m$^2$ | 1.023−(0.095){(z−1.0)/0.2}+(0.1838){(f−0.8)/0.4}−(0.12){(n−0.17)/0.185}−(0.065){(T−46)/6}{(n−0.17)/0.185}−(0.08){(f−0.8)/0.4}{(n−0.17)/0.185} |
| CRS P-ratio = | 0.7937−(0.06438){(z−1.0)/0.2}+(0.03937){(n−0.17)/0.185}+(0.04687){(z−1.0)/0.2}{(n−0.17)/0.185} |
| CRS APGE, = mm | 2.353−(0.1313){(T−46)/6}−(0.05625){(z−1.0)/0.2}+(0.08125){(f−0.8)/0.4}+(0.2063){(n−0.17)/0.185}+(0.06875){(T−46)/6}{(z−1.0)/0.2}−(0.06875){(T−46)/6}{(f−0.8)/0.4}−(0.09375){(z−1.0)/0.2}{(f−0.8)/0.4}−(0.1438){(z−1.0)/0.2}{(n−0.17)/0.185}−(0.05625){(f−0.8)/0.4}{(n−0.17)/0.185}+(0.2437){(T−46)/6}{(f−0.8)/0.4}{(n−0.17)/0.185}+(0.1938){(z−1.0)/0.2}{(f−0.8)/0.4}{(n−0.17)/0.185} |
| EG Ct.Wt., g/m$^2$ = | 2.657−(0.355){(T−46)/6}−(0.07125){(z−1.0)/0.2}−(0.2037){(f−0.8)/0.4}−(0.065){(T−46)/6}{(z−1.0)/0.2}+(0.08875){(z−1.0)/0.2}{(n−0.17)/0.185}−(0.1937){(f−0.8)/0.4}{(n−0.17)/0.185}+(0.27){(T−46)/6}{(f−0.8)/0.4}{(n−0.17)/0.185}−(0.12){(T−46)/6}{(z−1.0)/0.2}{(f−0.8)/0.4} |
| EG APGE, mm = | 2.489−(0.0875){(T−46)/6}{(n−0.17)/0.185}+(0.1375){(T−46)/6}{(z−1.0)/0.2}{(f−0.8)/0.4}−(0.1125){(z−1.0)/0.2}{(f−0.8)/0.4}{(n−0.17)/0.185} |
| EGA Ct.Wt., = g/m$^2$ | 2.368−(0.3288){(T−46)/6}+(0.1){(z−1.0)/0.2}−(0.1725){(f−0.8)/0.4}+(0.09625){(T−46)/6}{(f−0.8)/0.4}+(0.145){(z−1.0)/0.2}{(n−0.17)/0.185}−(0.28){(f−0.8)/0.4}{(n−0.17)/0.185}+(0.1562){(T−46)/6}{(z−1.0)/0.2}{(f−0.8)/0.4}−(0.1138){(T−46)/6}{(z−1.0)/0.2}{(n−0.17)/0.185}+(0.2012){(T−46)/6}{(f−0.8)/0.4}{(n−0.17)/0.185}−(0.11){(z−1.0)/0.2}{(f−0.8)/0.4}{(n−0.17)/0.185} |
| EGA APGE, = mm | 2.242+(0.3812){(f−0.8)/0.4}−(0.1063){(n−0.17)/0.185}−(0.08125){(T−46)/6}{(z−1.0)/0.2}+(0.08125){(T−46)/6}{(f−0.8)/0.4}+(0.1312){(z−1.0)/0.2}{(f−0.8)/0.4}−(0.1063){(z−1.0)/0.2}{(n−0.17)/0.185} |

Abbreviations and Other Notes for Table 1

"CRS" means "Cold Rolled Steel"; "Ct.Wt." means "Coating Weight"; "g/m$^2$" means "grams per square meter"; "APGE" is an arbitrary designation given by the Ford Motor Company to a particular type of accelerated corrosion test procedure designed to predict the likely extent of "cosmetic" corosion, with the test results being reported in millimeters of creep and/or corrosion from a scribe through the painted surface tested, so that the lowervalues are preferable; "mm" means "millimeters"; "EG" means "Electrogalvanized Steel", and this substrate was coated on the galvanized side; and "EGA" means "steel electroplated on both sides with a zinc-iron alloy".

surfaces alone. However, other substrates, particularly those with zinciferous surfaces, are often part of a total assembly being phosphated along with cold-rolled steel, especially in the automobile industry, and for this reason it is important to take account of the protective and aesthetic qualities of coatings formed on the common zinciferous-surfaced substrates, by contacting these substrates with sludge reducing phosphating compositions.) The equations in Table 1 can be used according to the invention to guide the search for minimum sludge generation toward conditions that do not sacrifice performance while also meeting typical automotive coating weight and P-ratio specifications.

Accordingly, one embodiment of this invention is a process for reducing the amount of sludge formed in a nitrite accelerated zinc phosphating process initially accomplished by contact at a first process temperature value ("T") between a metal substrate being phosphated and a first zinc phosphating liquid composition, the process according to the invention for reducing the amount of sludge formed comprising steps of:

(I) determining values for first zinc ("z"), first nitrite accelerator ("n"), and first Free Acid concentration values of the first zinc phosphating liquid composition;

(II) utilizing the values determined in step (I) together with the first process temperature to calculate a first predicted sludge quantity according to the equation:

$$\text{Sludge in g/m}^2 = 2.69-(0.1919)\{(T-46)/6\}-(0.3481)\{(z-1.0)/0.2\}+$$

-continued $$(0.7831)\{(f-0.8)/0.4-(0.3169)\{(n-0.17)/0.185\}-(0.2381)\{(T-46)/6\}\{(f-0.8)/0.4\}-(0.3406)\{(f-0.8)/0.4\}\{(n-0.17)/0.185\};$$

(III) selecting at least one of a second zinc, second nitrite accelerator, and second Free Acid concentration value and a second process temperature value having the property that, when said selected second value or values is or are substituted for the corresponding first values, a second predicted sludge value calculated according to the equation recited in step (II) with the selected second value(s) substituted for the corresponding first values is smaller than said first predicted sludge value; and (IV) resuming the nitrite accelerated zinc phosphating process with a second zinc phosphating liquid composition that differs from said first zinc phosphating liquid composition by having the second value(s) selected in step (III) instead of the corresponding first values, but with other compositional characteristics the same as in said first zinc phosphating liquid.

The empirical equations in Table 1 were determined in the manner set forth below.

Three commercially available, automotive type, substrates as described in the notes for Table 1 were phosphated and tested. A typical automotive pretreatment process was used to phosphate all of the test substrates and consisted of the following steps in the order given:

(i) Spray Alkaline Degrease for 90 seconds;

(ii) Spray Water Rinse for 30 seconds;

(iii) Spray Collodial Titanium Phosphate Conditioning for 30 seconds;

(iv) Immersion Phosphating for 120 seconds with a phosphating composition consisting of water and the following ingredients:

| Variable | Range of Variations |
|---|---|
| zinc | 0.8 to 1.2 g/l |
| free acid | 0.4 to 1.2 points |
| temperature | 40 to 52° C. |
| sodium nitrite accelerator | 0.09 to 0.25 g/l |
| **Fixed** | **Concentration** |
| nickel | 0.8 g/l |
| nitrate | 6.5 g/l |
| fluoride | 1.0 g/l |
| phosphate | 15.5 g/l |
| manganese | 0.5 g/l |

(v) Spray Water Rinse for 30 seconds; and (vi) Spray Deionized Water Rinse for 15 seconds.

The specific conditions used are detailed in Table 2; they constitute nineteen experimental variations of the zinc phosphate bath used to study the effect of temperature, free acid, zinc and accelerator on sludge generation. These nineteen experiments make up a four factor, two level, fill factorial design with three replications of the center point. For ease of use, and to equally weight the effect of each variable's impact over its varied region of study, all values for the experimental variables are expressed in a "+1, 0, −1" format. All other phosphating bath components/conditions were kept constant between experiments. The DOE center point was chosen so that it coincides with conditions for many current practical uses of this type of zinc phosphating bath and can therefore be used as a reference point for performance comparisons. All test specimens subjected to Ford APGE cosmetic corrosion testing were coated, before being tested, with a PPG ED-4 electrocoat primer and top coated with a Dupont 872-AB-839 white base coat and

TABLE 2

| Variable Setting | | | | Measured Characteristic | | | | | | | | |
|---|---|---|---|---|---|---|---|---|---|---|---|---|
| | | | | Uncoated Cold Rolled Steel | | | | | | | | |
| | Zinc | | $NaNO_2$ | | Metal | | | | Zinc Coated | | Zinc Iron Coated | |
| Temperature | Concentration | Free Acid | Concentration | Sludge, $g/m^2$ | Ct. Wt., $g/m^2$ | Loss, $g/m^2$ | P-ratio | APGE, mm | Ct. Wt. $g/m^2$ | APGE, mm | Ct. Wt., $g/m^2$ | APGE, mm |
| −1 | −1 | −1 | −1 | 1.98 | 2.75 | 0.87 | 0.82 | 1.5 | 2.80 | 2.4 | 2.54 | 2.0 |
| 1 | −1 | −1 | −1 | 2.09 | 3.05 | 0.95 | 0.85 | 1.8 | 2.98 | 2.8 | 2.33 | 1.9 |
| −1 | 1 | −1 | −1 | 2.06 | 4.31 | 0.92 | 0.57 | 2.2 | 2.80 | 2.2 | 2.43 | 2.2 |
| 1 | 1 | −1 | −1 | 1.61 | 4.43 | 0.85 | 0.67 | 2.6 | 2.13 | 2.3 | 1.96 | 1.7 |
| −1 | −1 | 1 | −1 | 5.07 | 1.11 | 1.64 | 0.88 | 3.0 | 3.44 | 2.5 | 3.19 | 2.4 |
| 1 | −1 | 1 | −1 | 4.50 | 2.20 | 1.59 | 0.87 | 2.0 | 2.09 | 2.4 | 1.81 | 2.3 |
| −1 | 1 | 1 | −1 | 3.98 | 1.80 | 1.30 | 0.51 | 2.5 | 3.21 | 2.5 | 2.63 | 2.9 |
| 1 | 1 | 1 | −1 | 3.18 | 2.23 | 1.17 | 0.78 | 1.7 | 1.89 | 2.9 | 2.49 | 3.0 |
| −1 | −1 | −1 | 1 | 2.03 | 1.70 | 0.79 | 0.84 | 3.3 | 3.51 | 2.2 | 2.87 | 1.8 |
| 1 | −1 | −1 | 1 | 2.67 | 2.05 | 1.02 | 0.85 | 2.4 | 2.66 | 2.5 | 1.97 | 1.9 |
| −1 | 1 | −1 | 1 | 1.58 | 2.46 | 0.72 | 0.82 | 2.4 | 3.82 | 2.8 | 4.11 | 1.7 |
| 1 | 1 | −1 | 1 | 1.65 | 2.37 | 0.74 | 0.82 | 2.1 | 2.34 | 2.1 | 2.29 | 1.3 |
| −1 | −1 | 1 | 1 | 3.76 | 1.43 | 1.28 | 0.84 | 2.7 | 2.40 | 2.7 | 1 91 | 2 2 |
| 1 | −1 | 1 | 1 | 2.62 | 1.56 | 0.95 | 0.83 | 2.7 | 2.10 | 2.4 | 1.70 | 2.7 |
| −1 | 1 | 1 | 1 | 3.01 | 1.65 | 1.07 | 0.82 | 2.4 | 2.27 | 2.3 | 2.07 | 2.6 |
| 1 | 1 | 1 | 1 | 2.08 | 1.87 | 0.80 | 0.76 | 2.6 | 2.38 | 2.4 | 1.94 | 2 5 |
| 0 | 0 | 0 | 0 | 2.45 | 1.94 | 0.94 | 0.84 | 2.2 | 2.62 | 2.6 | 2.16 | 2.4 |
| 0 | 0 | 0 | 0 | 1.98 | 1.85 | 0.79 | 0.85 | 2.3 | 2.55 | 2.8 | 2.30 | 2.4 |
| 0 | 0 | 0 | 0 | 2.83 | 1.80 | 1.04 | 0.86 | 2.3 | 2.49 | 2.5 | 2.29 | 2.7 |

RK3840 clear coat paint system.

The cold rolled steel test panels used to measure metal loss and coating weight were acetone cleaned, dried, and weighed before phosphating. After phosphating the panels were reweighed, stripped of their phosphate coating using a 5% chromic acid solution in water and then rinsed, dried, and weighed again. All other substrates were processed as received and stripped of their phosphate coatings at room temperature using a solution of 40 grams of ammonium dichromate dissolved in 2.5 liters of reagent grade aqueous ammonia. The difference in the weight of the panel before phosphating and after stripping is considered the etch weight or metal loss, while the difference in weight just before and after stripping is considered the coating weight. Both metal loss and coating weight are expressed as weight per unit area.

P-ratios of the cold rolled steel coatings were obtained by x-ray diffraction according to methods taught by T. Miyawaki, H. Okita, S. Umehara, and M. Okabe, Proc. *Interfinish*, 80, 303 (1980) and/or by M. O. W Richardson and D. B. Freeman, *Tran. IMF*, 64(1), 16 (1986). Analysis was made at room temperature using a copper x-ray source. The intensities of the peaks related to the plane (100) of phosphophyllite and to the plane (020) of hopeite were measured and used to calculate coating P-ratio, which is defined as the ratio of phosphophyllite (Fe-containing zinc phosphate) to the total of phosphophyllite and hopeite (Zn-only zinc phosphate). Metal loss, coating weight, and P-ratio results are reported as an average of triplicate samples in Table 2.

As an estimate of phosphate coating performance, the fully painted and then scribed panels for each DOE variation were tested for resistance to cosmetic corrosion using the Ford APGE accelerated corrosion test. After 20 cycles of exposure all panels were scraped and taped to remove any loose paint and the maximum creepage across the scribe was measured at 10 equidistant points along the scribe. For each DOE variation all substrates were tested in duplicate and an average creepage across the scribe reported for each substrate based on twenty measurements. These results are also shown in Table 2.

Regression equations for all of the measured or calculated response characteristics were developed using the computerized statistical design of experiments program X-Stat™ as described by J. S. Murray, Jr., *X-Stat* (John Wiley & Sons, Inc., New York, 1984) and the 19 experiment, four factor, two level, full factorial, replicated center point, experimental design. By using a full factorial design with replicated center points, it was possible to calculate regression equations containing interactive terms of up to three factors:

$$Y=b_0+b_1X_1+b_2X_2+b_3X_3+b_4X_4+b_{12}X_1X_2+b_{13}X_1X_3+\ldots+b_{34}X_3X_4+b_{123}X_1X_2X_3+\ldots+b_{234}X_2X_3X_4.$$

Refinement of the regression equations was achieved by removing those terms in the regression that had associated with them a low level of confidence that they are not equal to zero. In all of the regressions except that developed for the electrogalvanized zinc iron Ford APGE results, terms retained in the finalized regression equation exhibit confidence levels of 95% or greater. The electrogalvanized zinc iron regression included terms with confidence levels as low as 87%. The relative effect that each term has on the measured characteristic is expressed by the magnitude and sign of each term's coefficient. This normalization of the terms' coefficients is accomplished by expressing each variable's settings as −1 to +1 during the statistical analysis. (In Table 1, however, the regression equations have been revised so as to generated predicted values when actual values of the variables, within the range studied, are used in them.)

Listed in Table 3 are the standard deviation and $R^2$ statistics for each of the regression equations in Table 1. Within the region of study, the $R^2$ value indicates the degree to which the regression equation explains the observed variation of the characteristic about its mean. Any single additional measurement of the characteristic should fall, with roughly a 70% probability, within the range of the regression equation's predicted response, plus or minus the standard deviation.

Table 4 summarizes the regression equations' predicted results for some "what if" phosphating condition scenarios and the computer-determined minimum sludge conditions when performance constraints for coating weight, P-ratio, and Ford APGE cosmetic corrosion are simultaneously applied. Simply decreasing the free acid to its lowest setting (0.4 points, or −1) results in a 21% reduction in sludge compared with the DOE center point. Raising the free acid from 0.4 to 0.6 point, only 25% of the region of study, results in a significant loss of sludge reduction capability so that now only a 5% reduction in sludge is realized. Operating the variables at their half-way points between their individual beneficial extremes results in a 16.5% reduction in sludge and would present less of an operational stability problem for the zinc phosphate solution than the low free acid

TABLE 3

| Predicted Value | Standard Deviation | $R^2$ Value, % |
|---|---|---|
| Sludge, g/m$^2$ | 0.36 | 91.7 |
| CRS Ct.Wt., g/m$^2$ | 0.40 | 83.7 |
| CRS Metal Loss, g/m$^2$ | 0.12 | 84.7 |
| CRS P-ratio | 0.06 | 68.3 |
| CRS APGE, mm | 0.10 | 97.9 |
| EG Ct.Wt., g/m$^2$ | 0.11 | 97.6 |
| EG APGE, mm | 0.14 | 66.9 |
| EGA Ct.Wt., g/m$^2$ | 0.14 | 97.2 |
| EGA APGE, mm | 0.20 | 86.6 |

TABLE 4

| Variable Settings for Predicted Responses | | | | | Actual or Pre- | |
|---|---|---|---|---|---|---|
| T, ° C. | Zn, g/l | FA points | g/l of Nitrite | Regression Constraints/Comments | dicted Sludge g/m2 Produced | % Reduction |
| 46 | 1.0 | 0.8 | 0.17 | DOE Center (actual results) | 2.42 | |
| 46 | 1.0 | 0.4 | 0.17 | Free Acid = 0.4 points | 1.91 | 21.0 |
| 46 | 1.0 | 0.6 | 0.17 | Free Acid = 0.6 points | 2.30 | 5.0 |
| 40 | 1.2 | 0.4 | 0.09 | Unconstrained minimum sludge | 1.49 | 38.4 |

TABLE 4-continued

| Variable Settings for Predicted Responses | | | | | Actual or Predicted Sludge | |
|---|---|---|---|---|---|---|
| T, ° C. | Zn, g/l | FA points | g/l of Nitrite | Regression Constraints/Comments | g/m2 Produced | % Reduction |
| 49 | 1.1 | 0.6 | 0.21 | All independent variables at average value of DOE value and most beneficial extreme within range studied | 2.02 | 16.5 |
| 46.6 | 1.2 | 0.4 | 0.24 | P-ratio ≧ 0.80<br>1.6 ≦ CRS CT.WT. ≧ 3.0<br>EG CT.WT. ≦ 3.0<br>EGA CT.WT. ≦ 3.0 | 1.59 | 34.3 |
| 40 | 0.8 | 0.4 | 0.12 | P-ratio ≧ 0.86<br>1.6 ≦ CRS CT.WT. ≧ 3.0<br>EG CT.WT. ≦ 3.0<br>EGA CT.WT. ≦ 3.0 | 2.18 | 9.9 |

condition of 0.4 points.

Minimizing for sludge generation with no constraints applied produces a very large sludge reduction of 38.4% but also results in a low cold rolled steel P-ratio and high cold rolled steel coating weight. In addition, at the conditions prescribed for this minimum sludge production, crystal morphology and coating uniformity could begin to degrade. When the minimization is performed while applying performance constraints for coating weight, P-ratio and Ford APGE corrosion, only a small sacrifice is made in sludge reduction capability as the percent reduction goes to 34.3%. Increasing the P-ratio constraint diminishes sludge reduction to approximately 10 percent.

Accordingly, another embodiment of the invention is an aqueous liquid composition for zinc phosphating, said composition comprising in addition to water:

(A) an amount of dissolved zinc cations that preferably is at least, with increasing preference in the order given, 0.20, 0.30, 0.40, 0.50, 0.60, 0.65, 0.70, 0.75, or 0.8 grams per kilogram of total composition (hereinafter usually abbreviated as "g/kg") and independently preferably is not more than, with increasing preference in the order given, 2.2, 2.0. 1.8. 1.6, 1.40, 1.30, 1.25, or 1.20 g/kg;

(B) an amount of dissolved phosphate ions, including the stoichiometric equivalent as phosphate ions of all phosphoric and condensed phosphoric acids in which phosphorus has a formal valence of +5 and of all salts of these acids, said amount preferably being at least, with increasing preference in the order given, 3.0, 5.0, 7.0, 8.0, 9.0, 10.0, 11.0, 12.0, 13.0, 14.0, 14.5, 15.0, or 15.4 g/kg and independently preferably is not more than, with increasing preference in the order given, 100, 80, 70, 60, 50, 40, 35, 30, 25, 20, 18, or 16 g/kg; and (C) an amount of dissolved nitrite ions that preferably is at least, with increasing preference in the order given, 0.005, 0.007, 0.009, 0.012, 0.015, 0.020, 0.025, 0.030, 0.035, 0.040, 0.045, 0.050, 0.055, 0.060, 0.065, 0.070, 0.075, 0.080, 0.085, or 0.089 g/kg and independently preferably is not more than, with increasing preference in the order given, 5.0, 4.0, 3.0, 2.0, 1.5, 1.0, 0.80, 0.60, 0.50, 0.45, 0.40, 0.35, 0.30, or 0.26 g/kg; and; and (D) at least 0.020 point but not more than, with increasing preference in the order given, 0.80, 0.75, 0.70, 0.65, 0.60, 0.55, 0.50, 0.45, 0.40, 0.35, 0.30, 0.25, 0.20, 0.15, 0.10, or 0.050 point of Free Acid value; and, optionally, one or more of the following components:

(E) an amount of dissolved nickel cations that is at least, with increasing preference in the order given, 0.03, 0.05, 0.08, 0.12, 0.16, 0.20, 0.24, 0.28, 0.32, 0.37, 0.42, 0.47, 0.53, 0.59, 0.64, 0.70, 0.74, or 0.78 g/kg and independently preferably is not more than, with increasing preference in the order given, 3.0, 2.5, 2.0, 1.5, 1.2, 1.10, 1.00, 0.95, 0.90, 0.86, or 0.82 g/kg;

(F) an amount of dissolved manganese cations that is at least, with increasing preference in the order given, 0.03, 0.05, 0.08, 0.12, 0.16, 0.20, 0.24, 0.28, 0.32, 0.37, 0.40, 0.43, 0.46, or 0.49 g/kg and independently preferably is not more than, with increasing preference in the order given, 3.0, 2.5, 2.0, 1.5, 1.2, 1.0, 0.80, 0.70, 0.65, 0.60, 0.55, or 0.51 g/kg;

(G) an amount of dissolved fluoride anions, including the stoichiometric equivalent as fluoride ions of all dissolved hydrofluoric, fluoboric (i.e., $HBF_4$), fluozirconic (i.e., $H_2ZrF_6$), fluohafnic (i.e., $H_2HfF_6$), fluotitanic (i.e., $H_2TiF_6$), fluoaluminic (i.e., $H_3AlF6$), fluoferric (i.e., $H_3FeF_6$), and fluosilicic (i.e., $H_2SiF_6$) acids and of all of the partially and completely neutralized salts of all of these acids, irrespective of the actual degree of ionization prevailing in the composition, that is at least, with increasing preference in the order given, 0.10, 0.30, 0.50, 0.60, 0.70, 0.80, 0.85, 0.90, or 0.95 g/kg and independently preferably is not more than, with increasing preference in the order given, 12, 10, 8, 7.0, 6.0, 5.0, 4.0, 3.0, 2.5, 2.0, 1.8, 1.6, 1.4, 1.2, or 1.05 g/kg; and (H) an amount of dissolved nitrate anions, including the stoichiometric equivalent as nitrate of any nitric acid added to the composition, that is at least, with increasing preference in the order given, 0.30, 0.50, 0.80, 1.2, 1.6, 2.0, 2.4, 2.8, 3.2, 3.6, 4.0, 5.0, 6.0, or 6.4 glkg and independently preferably is not more than, with increasing preference in the order given, 50, 40, 30, 25, 20, 15, 12, 10, 9.0, 8.5, 8.0, 7.5, 7.0, or 6.6 g/kg.

The presence in the composition of each of the above noted optional components is individually and independently preferred, except when dangers of pollution motivate exclusion of one or more of the components, e.g., nickel, discharges of which are severely limited in many jurisdictions.

Another embodiment of the invention is a process of forming a zinc phosphate conversion coating on a metal substrate surface, preferably one which contains at least 50% of at least one metal selected from the group consisting of iron, zinc, and aluminum, by contacting said surface with a composition according to the invention as described above at a temperature that preferably is at least, with increasing preference in the order given, 30, 33, 36, or 39° C. and independently preferably is, with increasing preference in the order given, not more than 60, 58, 56, 54, or 52° C.

Further appreciation of the present invention may be had from the following examples and comparison examples which are intended to illustrate, but not limit, the invention.

To confirm the usefulness of the sludge regression equation's predicting capabilities, two of the sets of independent variables from Table 4 were tested experimentally. These were the best sludge reduction conditions when performance constraints were applied, specifically (1) Free Acid=0.4 points, Zn concentration=1.2 grams per liter, sodium nitrite concentration=0.24 grams per liter, and temperature=46.6° C, predicted to achieve a 34.3% sludge reduction and (2) Free Acid=0.6 points, Zn concentration=1.1 grams per liter, sodium nitrite concentration=0.21 grams per liter, and temperature=49° C., predicted to achieve a 16.5% sludge reduction. The actual sludge reductions achieved were 33.1% and 15.7% respectively, in close agreement with the predicted values.

The invention claimed is:

1. An aqueous liquid composition for zinc phosphating, said composition comprising in addition to water:

(A) an amount of dissolved zinc cations that is from about 0.20 to about 2.2 g/kg;

(B) an amount of dissolved phosphate ions, including the stoichiometric equivalent as orthophosphate (i.e., $PO_4^{-3}$) ions of all phosphoric and condensed phosphoric acids in which phosphorus has a formal valence of +5 and of all salts of these acids present in the composition, that is from about 30 about 100 g/kg;

(C) an amount of dissolved nitrite ions that is from 0.070 to about 0.60 g/kg;

(D) at least about 0.020 point but not more than 0.60 point of Free Acid value;

(E) an amount of dissolved nickel cations that is from about 0.24 to about 3.0 g/kg;

(F) an amount of dissolved manganese cations that is from about 0.12 to about 3.0 g/kg; and (G) an amount of dissolved fluoride anions, including the stoichiometric equivalent as fluoride ions of all dissolved hydrofluonic, fluobonic, fluozirconic, fluohafnic, fluotitantic, fluoaluminic, fluoferric, and fluosilicic acids and of all of the partially and completely neutralized salts of all of these acids irrespective of the actual degree of ionization prevailing in the composition, that is from about 0.50 to about 12 g/kg.

2. A composition according to claim 1, wherein:

the amount of component (A) is from about 0.40 about 2.0 g/kg;

the amount of component (B) is from about 7.0 to about 70 g/kg;

the amount of component (C) is from about 0.070 to about 0.60 g/kg; and the amount of component (E) is from about 0.24 to about 1.5 g/k.

3. A composition according to claim 2, wherein:

the amount of component (A) is from about 0.50 to about 1.8 g/kg;

the amount of component (B) is from about 9.0 to about 50 g/kg;

the amount of component (C) is from about 0.070 to about 0.60 g/kg;

the amount of component (E) is from about 0.28 to about 1.2 g/kg;

the amount of component (F) is from about 0.24 to about 2.0 g/kg; and the composition additionally comprises:

(H) an amount of dissolved nitrate anions, including the stoichiometric equivalent as nitrate of any nitric acid added to the composition, that is from about 1.2 to about 50 g/kg.

4. A composition according to claim 3, wherein:

the amount of component (A) is from about 0.60 to about 1.6 g/kg;

the amount of component (B) is from about 11.0 to about 35 g/kg;

the amount of component (C) is from about 0.070 to about 0.50 g/kg;

the amount of component (E) is from about 0.42 to about 1.2 g/kg;

the amount of component (F) is from about 0.32 to about 1.5 g/kg;

the amount of component (G) is from about 0.50 to about 6.0 g/kg; and the amount of component (H) is from about 2.4 to about 25 g/kg.

5. A composition according to claim 4, wherein:

the amount of component (A) is from about 0.60 to about 1.6 g/kg;

the amount of component (B) is from about 11.0 to about 35 g/kg;

the amount of component (C) is from about 0.070 to about 0.50 g/kg;

the amount of component (E) is from about 0.42 to about 1.2 g/kg;

the amount of component (F) is from about 0.32 to about 1.5 g/kg;

the amount of component (G) is from about 0.50 to about 6.0 g/kg; and the amount of component (H) is from about 2.4 to about 25 g/kg.

6. A composition according to claim 5, wherein:

the amount of component (A) is from about 0.70 to about 1.40 g/kg;

the amount of component (B) is from about 12.0 to about 25 g/kg;

the amount of component (C) is from about 0.070 to about 0.45 g/kg;

the amount of component (E) is from about 0.59 to about 1.00 g/kg;

the amount of component (F) is from about 0.43 to about 1.0 g/kg;

the amount of component (G) is from about 0.70 to about 3.0 g/kg; and the amount of component (H) is from about 3.6 to about 12 g/kg.

7. A composition according to claim 6, wherein: the amount of component (A) is from about 0.80 to about 1.20 g/kg; the amount of component (B) is from about 14.0 to about 20 g/kg; the amount of component (C) is from about 0.070 to about 0.40 g/kg; the amount of component (E) is from about 0.70 to about 0.90 g/kg; the amount of component (F) is from about 0.46 to about 0.70 g/kg; the amount of component (G) is from about 0.80 to about 2.0 g/kg; and the amount of component (H) is from about 5.0 to about 10 g/kg.

8. A composition according to claim 7, wherein: the amount of component (B) is from about 14.0 to about 18 g/kg; the amount of component (C) is from about 0.075 to about 0.35 g/kg; the amount of component (E) is from about 0.74 to about 0.86 g/kg; the amount of component (F) is from about 0.46 to about 0.60 g/kg; the amount of component (G) is from about 0.80 to about 1.6 g/kg; the amount of component (H) is from about 5.0 to about 7.5 g/kg.

9. A composition according to claim 8, wherein: the amount of component (B) is from about 15.0 to about 16.0 g/kg; the amount of component (C) is from about 0.089 to about 0.26 g/kg; the amount of component (D) is from about 0.020 to about 0.25 point; the amount of component (E) is from about 0.78 to about 0.82 g/kg; the amount of component (F) is from about 0.49 to about 0.55 g/kg; the amount of component (G) is from about 0.95 to about 1.05 g/kg; and the amount of component (H) is from about 6.4 to about 6.6 g/kg.

10. A process of forming a zinc phosphate conversion coating on a metal substrate surface which contains at least 50% of at least one metal selected from the group consisting of iron, zinc, and aluminum, by contacting said surface with a composition according to claim 9 at a temperature from about 39 to about 52° C.

11. A process of forming a zinc phosphate conversion coating on a metal substrate surface which contains at least 50% of at least one metal selected from the group consisting of iron, zinc, and aluminum, by contacting said surface with a composition according to claim 8 at a temperature from about 36 to about 54° C.

12. A process of forming a zinc phosphate conversion coating on a metal substrate surface which contains at least 50% of at least one metal selected from the group consisting of iron, zinc, and aluminum, by contacting said surface with a composition according to claim 7 at a temperature from about 33 to about 56° C.

13. A process of forming a zinc phosphate conversion coating on a metal substrate surface which contains at least 50% of at least one metal selected from the group consisting of iron, zinc, and aluminum, by contacting said surface with a composition according to claim 6 at a temperature from about 30 to about 58° C.

14. A process of forming a zinc phosphate conversion coating on a metal substrate surface which contains at least 50% of at least one metal selected from the group consisting of iron, zinc, and aluminum, by contacting said surface with a composition according to claim 5 at a temperature from about 30 to about 60° C.

15. A process of forming a zinc phosphate conversion coating on a metal substrate surface which contains at least 50% of at least one metal selected from the group consisting of iron, zinc, and aluminum, by contacting said surface with a composition according to claim 4 at a temperature from about 30 to about 60° C.

16. A process of forming a zinc phosphate conversion coating on a metal substrate surface which contains at least 50% of at least one metal selected from the group consisting of iron, zinc, and aluminum, by contacting said surface with a composition according to claim 3 at a temperature from about 30 to about 60° C.

17. A process of forming a zinc phosphate conversion coating on a metal substrate surface which contains at least 50% of at least one metal selected from the group consisting of iron, zinc, and aluminum, by contacting said surface with a composition according to claim 2 at a temperature from about 30 to about 60° C.

18. A process of forming a zinc phosphate conversion coating on a metal substrate surface which contains at least 50% of at least one metal selected from the group consisting of iron, zinc, and aluminum, by contacting said surface with a composition according to claim 1 at a temperature from about 30 to about 60° C.

* * * * *

UNITED STATES PATENT AND TRADEMARK OFFICE

CERTIFICATE OF CORRECTION

PATENT NO. : 5,900,073
DATED : May 4, 1999
INVENTOR(S) : Michael L. Sienkowski and Michael Petschel It is certified that error appears in the above-identified patent and that said Letters Patent is hereby corrected as shown below:

Column 11,
Line 30, delete “30” and insert in place thereof -- 3.0 --.
Line 42, delete “hydrofluonic, fluobonic” and insert in place thereof -- hydrofluoric, fluoboric --.
Line 43, delete “fluotitantic” and insert in place thereof -- fluotitanic --.

Signed and Sealed this

Thirtieth Day of July, 2002

*Attest:*

*Attesting Officer*

JAMES E. ROGAN
*Director of the United States Patent and Trademark Office*